US006670746B2

(12) United States Patent
Gorog

(10) Patent No.: US 6,670,746 B2
(45) Date of Patent: Dec. 30, 2003

(54) CATHODE RAY TUBE ELECTRICAL CONNECTOR WITH THROUGH PASSAGE AND LEAF SPRINGS

(75) Inventor: Istvan Gorog, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 10/021,615

(22) Filed: Dec. 12, 2001

(65) Prior Publication Data

US 2003/0107310 A1 Jun. 12, 2003

(51) Int. Cl.[7] ..... H01J 31/00
(52) U.S. Cl. ..... 313/477 HC; 313/318.01
(58) Field of Search ..... 313/477 HC, 318.01, 313/318.03, 318.05, 318.09, 51; 439/613, 614, 617, 618

(56) References Cited

U.S. PATENT DOCUMENTS

| | | | | |
|---|---|---|---|---|
| 1,818,333 | A | 8/1931 | Juergens | |
| 2,552,456 | A | 5/1951 | Probeck | 173/328 |
| 2,741,751 | A | 4/1956 | Weiler | 339/217 |
| 2,974,192 | A | 3/1961 | Marholz | |
| 3,944,892 | A | 3/1976 | Johnson et al. | 317/120 |
| 3,979,157 | A | 9/1976 | DiMattio | 339/17 |
| 4,012,094 | A | 3/1977 | VanRenssen et al. | 339/17 |
| 4,338,635 | A | 7/1982 | Haider et al. | 358/254 |
| 4,366,415 | A | 12/1982 | Takenaka et al. | 313/457 |
| 4,379,978 | A | 4/1983 | Hockenbrock | 313/318 |
| 4,565,420 | A | 1/1986 | Brunn | 339/193 |
| 4,590,540 | A | 5/1986 | Nicholson et al. | 361/400 |
| 4,739,218 | A | 4/1988 | Schwartz | 313/433 |
| 4,812,708 | A | 3/1989 | Chang | 313/477 |
| 4,873,578 | A | 10/1989 | Tognoni et al. | 358/254 |
| 5,045,974 | A | 9/1991 | Ohkoshi et al. | 361/399 |
| 5,202,615 | A | 4/1993 | An | 313/456 |
| 5,751,101 | A | 5/1998 | Takanobu et al. | 313/405 |
| 5,963,275 | A | 10/1999 | Cho | 348/836 |
| 2001/0015606 | A1 | 8/2001 | Arakawa et al. | 313/318.01 |

FOREIGN PATENT DOCUMENTS

| | | | |
|---|---|---|---|
| DE | 2802 333 A1 | 7/1979 | H01J/29/92 |
| GB | 548097 | 6/1941 | 7360/41 |
| WO | WO01/31670 | 10/2000 | H01J/5/62 |

*Primary Examiner*—Ashok Patel
*Assistant Examiner*—Glenn D. Zimmerman
(74) *Attorney, Agent, or Firm*—Joseph S. Tripoli; Joseph J. Laks; Carlos M. Herrera

(57) ABSTRACT

The present invention relates to a cathode ray tube (CRT) having an improved electrical connector. An electrical connector is provided for detachably coupling an electrical lead to the electron gun through the neck of the CRT. The connector has a through passage defined by a diameter greater than the diameter of the neck. The neck is inserted in the passage and the connector is secured to the outer surface of the neck. Adjacent the passage is a plurality of integral resilient leaf springs extending toward the stem at a plurality of circumferentially spaced locations. The leaf spring elements include base elements for terminal engagement and tip ends projecting and bias toward the electrical leads of the electron gun to provide electrical connection to the cathode ray tube. The passage of the connector is preferably defined by an opening in a printed circuit board or other electrical terminal contact from which the leaf springs extend.

6 Claims, 2 Drawing Sheets

CATHODE RAY TUBE ELECTRICAL CONNECTOR WITH THROUGH PASSAGE AND LEAF SPRINGS

FIELD OF THE INVENTION

The present invention generally relates to cathode ray tubes and specifically to a cathode ray tube having an improved electrical connector.

BACKGROUND OF THE INVENTION

This invention relates to cathode ray display tubes, and is particularly concerned with the electrical connection of such tubes at the neck region that provides for passing and isolating a number of electrically conductive pins that convey operating voltages into the tube envelope.

Cathode ray tubes used in television picture tubes, and in CRT monitors displaying a variety of information, typically have a narrow neck terminated by a plurality of electrically conductive pins extending axially from the electron gun through the neck of the tube. The pins may comprise a number of closely spaced, low-voltage pins, and at least one high-voltage pin spaced from the low-voltage pins. Electrical connection to the pins is typically made by a socket which provides for connecting by means of a plurality of frictional members which slidably contact each pin. The members are attached to a plurality of lead wires which in turn make connection to various components of the ancillary electrical chassis, such as the power supply and scanning circuits.

It has become desirable to manufacture tubes that allow for the design of televisions and monitors with a slim profile. That is, televisions and monitors with cabinets having reduced depth. A conventional socket as discussed above, has one objectionable characteristic and that is that it extends the overall length of the tube, as measured by the front to back dimension. This single geometrical dimension results in the increased depth of the tube cabinet. A well known approach to decreasing the overall length of the tube is to increase the deflection angle of the electron gun beam trajectory relative to the tube longitudinal axis thereby permitting the electron gun to be brought closer to the viewing screen of the tube and thus shortening the overall length of the tube. For example, a typical twenty-inch diagonal CRT has a 90 degree deflection angle. Increasing the deflection angle to 110 degrees decreases the overall length of the tube approximately three-inches. Further increase in deflection angle is possible, however, the marginal gain in length reduction of the tube progressively decreases as the angle of deflection increases. For example, increasing the deflection angle from 110 degrees to 130 degrees of a 20-inch diagonal CRT results in a depth reduction of approximately 2.3 inches. Increasing the electron beam deflection angle also tends to create other challenges including an increase in the deflection frequency and current supplied to the deflection yoke resulting in increase power consumption of the CRT.

Therefore, it is desirable to provide additional means for reducing the overall length of the tube.

SUMMARY OF THE INVENTION

A cathode ray tube electrical connector is provided for detachably coupling an electrical lead to the electron gun. The connector has a through passage defined by a diameter greater than the diameter of the neck which surrounds and is secured to the outer surface of the neck. Adjacent the passage is a plurality of integral resilient leaf springs extending toward the stem at a plurality of circumferentially spaced locations. The leaf spring elements include base elements for terminal engagement and tip ends projecting and bias toward the electrical leads of the electron gun to provide electrical connection to the cathode ray tube. The passage of the connector is preferably defined by an opening in a printed circuit board or other electrical terminal contact from which the leaf springs extend.

BRIEF DESCRIPTION OF THE DRAWINGS

Preferred embodiments of the present invention will be described below in more detail, with reference to the accompanying drawings, in which.

DETAILED DESCRIPTION

Figure 1:
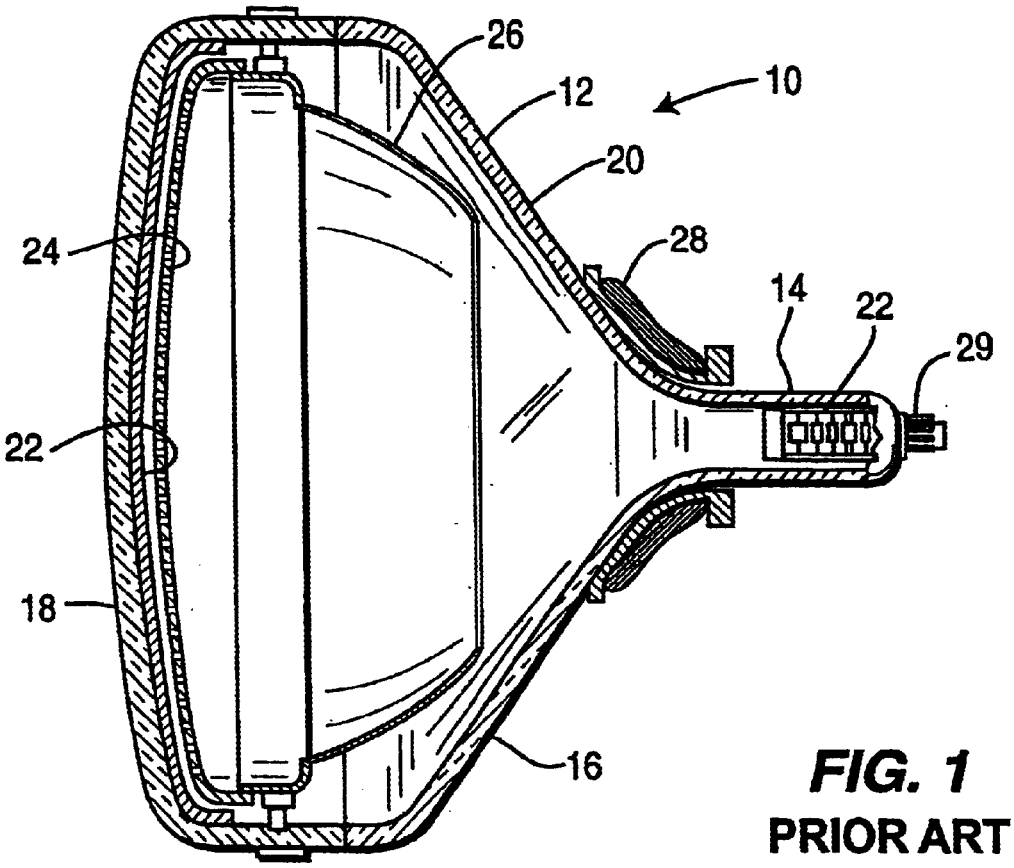
FIG. 1 PRIOR ART
FIG. 1 is a cross-sectional side view showing an example of a cathode ray tube with an electron gun connected therein according to the prior art.

As shown in FIG. 1, a known cathode-ray tube 10 is usually composed of a hermetically sealed, evacuated glass envelope 12 including a neck 14, a funnel 16 and a faceplate panel 18. The funnel 16 has an internal conductive coating (not shown) that extends from an anode button 20 toward the faceplate panel 18 and the neck 14. A three-color phosphor screen 22 is carried by the inner surface of the faceplate panel 18. A shadow mask frame assembly 24 is removably mounted in predetermined spaced relation to the screen 22. An internal magnetic shield 26 is fastened to the shadow mask frame assembly. Centrally mounted within the neck 14 is an electron gun 22 to generate and direct three inline electron beams (not shown), a center beam and two side or outer beams, along convergent paths through the tension mask frame assembly 24 to screen 22.

The CRT 10 is designed to be used with an external magnetic deflection yoke 28 shown in the neighborhood of the funnel-to-neck junction. When activated, the yoke 28 subjects the three beams to magnetic fields which cause the beams to scan horizontally and vertically in a rectangular raster over the screen 22.

Figure 2:
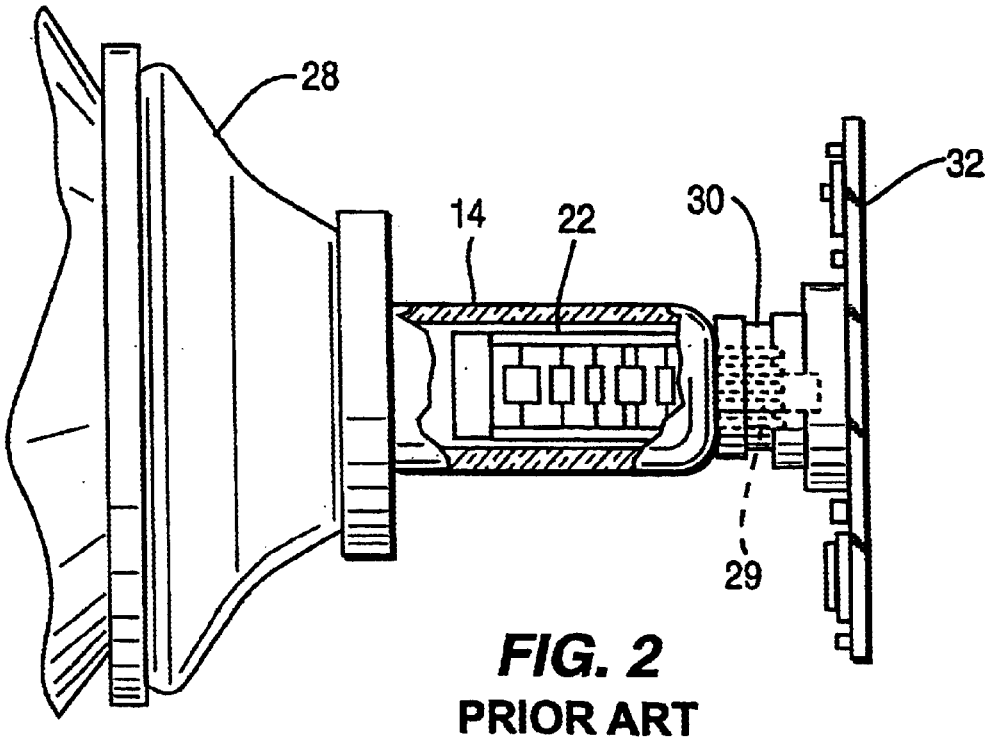
FIG. 2 PRIOR ART
FIG. 2 is a partial cross-sectional side view of a cathode ray tube showing the connection of an electron gun according to the prior art.

As illustrated in FIG. 2, a typical electron gun 22 includes a plurality of spaced electrodes centrally mounted within the neck 14 of the tube. Electrical connections between the outside and the inside of the above described envelope is the anode button 20 and stem pins 29. The stem pins 29 include closely spaced, low-voltage pins, and at least one high-voltage pin spaced from the low-voltage pins. The potentials conducted by the low-voltage pins may range from less than one volt to one kilovolt, for example. The potentials conducted by the high-voltage pin are typically in the range of six to twelve kilovolts, or greater. In certain television tube applications, an additional very high potential termed the "anode potential" is in the range of 25–32 kilovolts, and is introduced through the tube envelope by means of the anode button 20. Electrical connection to the pins is typically made by a socket 30 which provides for connecting by means of a plurality of frictional members therein (not shown) which slidably contact each stem pins 2829. The frictional members of the socket 30 are attached to a plurality of lead wires which in turn make connection to various components of the ancillary electrical chassis, such as the power supply and scanning circuits 32.

Figure 3:
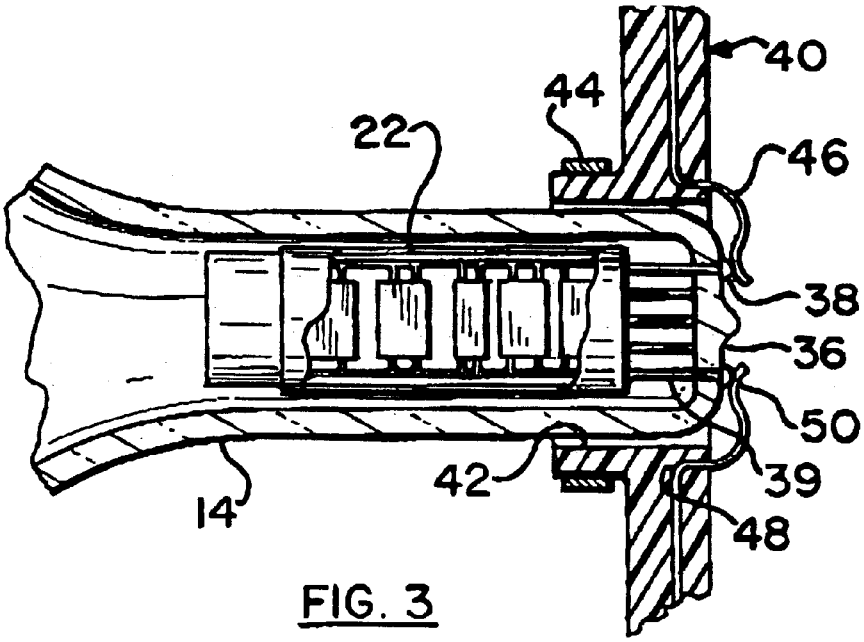
FIG. 3 is a partial cross-sectional side view of the present invention as taken along line 3—3 of FIG. 4.

FIG. 3 is a detail sectional side view, partial cutaway, of a cathode ray tube and electrical connector in accordance with the present invention. The cathode ray tube includes neck 14 with an electron gun 22 centrally positioned therein and an associated electrical leads 34 extending axially from the neck 14. The end of the neck 14 terminates at a closed end stem 36 through which electrical leads 39 extend to the outside surface of the tube. The electrical leads 34 include contact buttons 38 on the outer surface of the stem 36. It is to be understood that the electrical leads 39 and associated contacts 38 may comprise more than those depicted for exemplary purposes. Typically, the number of electrical leads may be as many as six or more in a single gun. The scope of the invention is not limited to the number of electrical leads or contacts shown, but is intended to cover both standard and unusual gun configurations to which the invention has applications. An electrical connector 40 embodying the invention is secured to the outside surface of the neck 14 near the stem for making electrical contact with the electron gun leads in a manner to be described.

Figure 4:
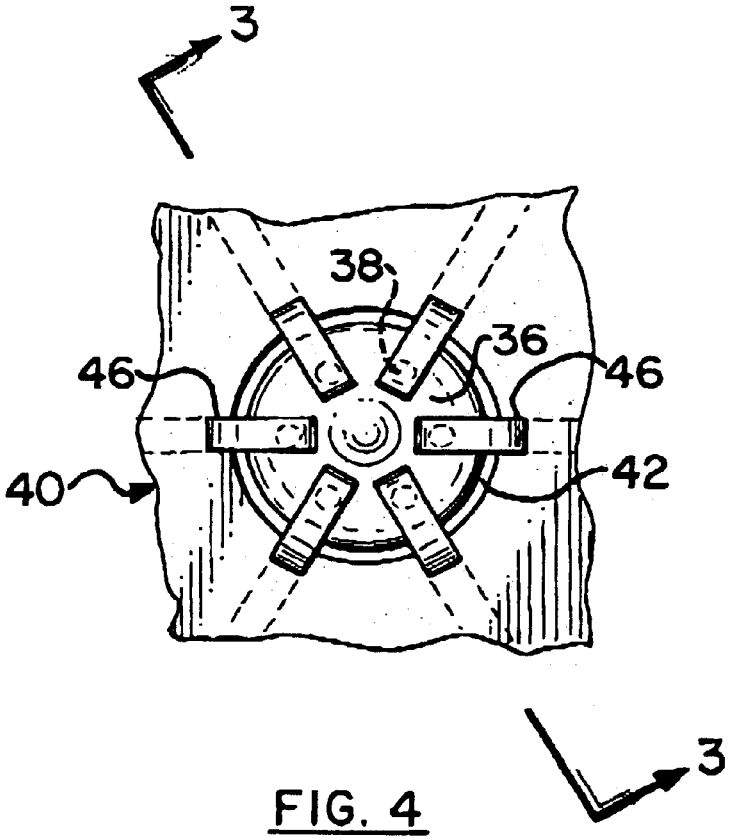
FIG. 4 is a plan view of the present invention as shown in FIG. 3.

Turning to FIGS. 3 and 4, the electrical connector 40 has a through passage 42 defined by a diameter greater than the outside surface diameter of the neck and extending away from the stem 36 toward the front faceplate panel 18 of the tube. The electrical connector 40 includes a cylindrical clamp 44 formed along the through passage surrounding the outside surface of the neck 14 for securing the connector 40 adjacent the proximal end, or stem 36, of the neck. It will be understood that the electrical connector 40 may also be secured to the outside surface of the neck with an adhesive or the like in lieu of the clamp 44. A plurality of integral resilient leaf springs 46 extend from the connector 40 at a plurality of circumferentially spaced locations to the contacts 38. The leaf springs 46 have base elements 48 for terminal engagement with various electrical components of the tube, and tip ends 50 which project and are biased toward the longitudinal axis of the connector for mating engagement with the contacts 38 of the electrical leads 39. The resilient leaf springs 46 extend from the base elements 48 at a plurality of spaced circumferential locations in accordance to the number and location of the electron gun leads 39 and associated contacts 38. The springs 46 and contacts 38 operate over a large range of voltage and can be electrically insulated from each other and from ground to prevent arcing that can damage the surrounding components of the tube. Several approaches can be used to achieve the insulation such as, for example, placing an insulating material having a high electrical breakdown voltage per unit thickness of material between the springs. In addition, contacts 38 and springs 46 operating at different voltages may be spaced apart or individually insulated so that arcing is suppressed. Since the connector 40 is secured to the neck, the overall axial length of the tube is reduced by the contour of the leaf springs 46 and the extension of the contacts 38 above the surface of the stem 36.

Preferably, the electrical connector 40 forms a printed circuit board with base elements 48 acting as an integral terminal contact with the various electrical components. It will also be understood as being within the purview of the invention to fabricate a modified electrical connector 40 such that the circuit board is separate from the connector wherein the leaf springs are secured to the outer surface of the neck 14 as described above but with the base elements 48 connected to a separate printed circuit board 32 by suitable means.

While foregoing is directed to the preferred embodiment of the present invention, other and further embodiments of the invention may be devised without departing from the basic scope thereof, and the scope thereof is determined by the claims that follow.

What is claimed is:

1. A cathode ray tube having an evacuated glass envelope including a neck, a funnel and a faceplate panel, the cathode ray tube having an electrical connector detachably coupled to electrical leads of an electron gun within the neck of the tube wherein the connector comprises:

a through passage defined by a diameter greater than the diameter of the neck and surrounding the outer surface of the neck; and, a plurality of resilient leaf springs extending from the connector at a plurality of circumferentially spaced locations toward the electrical leads of the electron gun wherein the springs include a base element for terminal engagement with electrical components of the tube and tip ends projecting and bias toward the electrical leads and in contact with the leads.

2. The cathode ray tube of claim 1 wherein the electrical connector further comprises a cylindrical clamp formed along the through passage surrounding the outside surface of the neck.

3. The cathode ray tube of claim 1 wherein the through passage of the connector is defined by an opening in a printed circuit of the tube.

4. A cathode ray tube including a faceplate panel and a funnel-shaped back section having a neck containing an electron gun and terminating at a closed end stem through which electrical leads of the electron gun extend to the outer surface of the stem, comprising:

an electrical connector secured to the neck and having a through passage defined by a diameter greater than the diameter of the neck extending toward the stem of the neck; and, a plurality of leaf springs including a base element fixed to the connector for terminal connection, each leaf spring extends from the base element toward the stem and includes a tip end biased toward the longitudinal axis of the tube for contacting the proximal end of an electrical lead of the electron gun upon securing the connector to the neck.

5. A cathode ray tube according to claim 4 wherein the leaf springs are spaced circumferentially.

6. A cathode ray tube according to claim 4 wherein the leaf springs are insulated such that the leaf springs are electrically isolated from each other.

* * * * *